US006164210A

United States Patent [19]

Coslovi et al.

[11] Patent Number: 6,164,210

[45] Date of Patent: Dec. 26, 2000

[54] REINFORCED HOPPER CAR STRUCTURE

[75] Inventors: Ilario A. Coslovi, Burlington; James W. Forbes, Waterloo, both of Canada

[73] Assignee: National Steel Car Limited, Canada

[21] Appl. No.: 09/086,354

[22] Filed: May 29, 1998

[51] Int. Cl.[7] ..... B61D 17/00; B60J 7/00

[52] U.S. Cl. ..... 105/396; 296/210; 52/45

[58] Field of Search ..... 105/247, 248, 105/355, 396, 407, 418; 296/181, 183, 210; 52/2.24, 17, 45, 47, 52

[56] References Cited

U.S. PATENT DOCUMENTS

| | | | |
|---|---|---|---|
| Re. 32,189 | 6/1986 | Adler et al. | 105/377 |
| 4,262,602 | 4/1981 | Patil et al. | 105/248 |
| 4,362,111 | 12/1982 | Stark et al. | 105/247 |
| 4,377,058 | 3/1983 | Hallam et al. | 52/45 |
| 4,385,563 | 5/1983 | Bell et al. | 105/377 |
| 4,444,123 | 4/1984 | Smith et al. | 105/377 |
| 4,455,947 | 6/1984 | Reeve et al. | 105/377 |

*Primary Examiner*—S. Joseph Morano
*Assistant Examiner*—Robert J. McCarry, Jr.
*Attorney, Agent, or Firm*—Oldham & Oldham Co., L.P.A.

[57] ABSTRACT

A hopper car is described that is a thin shelled integrated structure having a roof and a pair of sidewalls. This structure is subject to longitudinal tensile and compressive loads, and to a partial internal vacuum during unloading. Local buckling phenomena and collapse due to the partial vacuum need to be resisted. The roof assembly has lateral stiffeners to maintain its profile, and a reinforced, roll formed longitudinal coaming.

36 Claims, 13 Drawing Sheets

REINFORCED HOPPER CAR STRUCTURE

FIELD OF THE INVENTION

This invention relates to structures for railcars such as may be applicable, for example, to the reinforcement of hopper cars. One particular use for the invention is the reinforcement of hopper car roofs.

BACKGROUND OF THE INVENTION

The design of railway hopper cars is governed by three main requirements. First, the fully loaded weight of a 125 ton car must not exceed 315,000 lbs. Thus to maximize useful, load car designers try to minimize car weight. At present an empty grain hopper steel car may typically weigh about 63,000 lbs., such that lading in excess of 50,000 lbs. is permissible. Second, the car must withstand a draft load of 630,000 lbs. Third, the car must not buckle under buff loads of 650,000 to 1,000,000 lbs. when slowing or stopping. Under the first, dead weight, loading condition the car may be modelled as a simply supported hollow beam carrying a distributed vertical load in excess of 50,000 lbs., with a corresponding bending moment distribution. Under the second, tensile draft, and third, compressive buff, loading conditions the car is like a column, taking tensile and compressive loads.

The general structure of contemporary curved-sided hopper cars can be idealized as a load bearing monocoque in the form of a hollow, downwardly opening, generally C-shaped, thin walled, column. At each column end, the load is transferred through a transition structure from the shell into a stub sill and coupler by which the railcar is connected to the next rail car. The challenge in designing the structure for a hopper car, in general, is to reduce the mass of the thin shell, and any supporting structure, to a minimum while still maintaining the structural integrity required to withstand the given loads, and to transfer those loads between the couplers and the body shell. When the shell is made too thin it fails in compression due either to global buckling of the structure, or to the local buckling phenomenon of wrinkling. In such a hollow shell structure, the ability to resist the compressive buff load, without buckling, requires that the principle longitudinal structural components of the car, those being the roof and side walls, work together as a single integrated structure.

One way to reduce the weight of the car is to reduce the thickness of the roof. The thickness of the roof of a typical hopper car is commonly less than 3/16". Given a railcar length of roughly 60 feet and width of roughly 10 feet, the roof may be considered a thin shell structure. Under vertical loading conditions of the car, this thin shell structure is exposed to a compressive load, with a consequent tendency toward buckling or wrinkling. This tendency is increased when a compressive longitudinal load is also applied to the car.

In the past, hopper car roofs have been given an outwardly bulging curved panel form to resist buckling, and have been supported by internal bulkheads or partition sheets, such as disclosed in U.S. Pat. No. 4,275,662 of Adler, issued Jun. 30, 1981. For example, a three hopper rail car generally has two end walls and two intermediate partitions leaving three roof spans each having a length of 15 to 20 feet. The roof is supported along its outboard edges by top chord members frequently in the form of a closed hollow section as depicted, for example, in FIG. 2 of U.S. Pat. No. 4,275,662.

In U.S. Pat. No. 4,377,058 of Hallam et al., issued Mar. 22, 1983 partial, reinforced internal stiffeners, shown as web assemblies 34 and 36, extend internally across the full width of the car and maintain the curvature of the roof In general, internal fittings, and particularly internal welds, tend to be avoided if possible. First, internal welding tends to be more difficult. Second, each additional fitting creates one or more niches in which foodstuffs may collect and rot. Third, it is generally better to leave the inside of the hopper free of obstructions. Where stiffeners are used a common goal is to obtain adequate strength without adding unnecessary weight.

The unsupported spans of hopper car roofs between end walls and bulkheads have a tendency to deflect. In particular, rapid unloading of grain hoper cars is known to cause a partial vacuum inside the car which tends to draw the roof inward. This is more pronounced in grain hopper cars having a continuous, central, longitudinally extending, trough opening. It tends to cause the arcuate shape of the roof section to flatten. This problem worsens as the thickness of the roof material decreases. The central trough may be bordered by a coaming, and the deflection of the roof may tend not only to cause the coaming to deflect, but may also tend to twist the coaming and reduce its ability to strengthen the structure. Consequently as roof thickness is reduced to lower the weight of the car it is desirable to reinforce the roof so that it provides resistance to buckling and to deflection under internal vacuum comparable to a thicker un-reinforced roof It is also advantageous to provide stiffening to maintain a natural frequency comparable to previous roofs, as vibration remains a significant factor in railcar design generally.

In general, it would be advantageous to have, and there has been a long felt need for, an improved hopper car shell structure. To that end, it would be advantageous to have improved reinforcement of a hopper car roof.

SUMMARY OF THE INVENTION

The present invention provides, in one aspect, a reinforcement for an unsupported span of an hopper car roof structure subject to compressive forces applied in a longitudinal direction relative to the hopper car, the span having a desired cross-sectional profile, the reinforcement chosen from the set of reinforcement consisting of (a) a longitudinal beam for forming a border along an unsupported edge of the span, the beam having a first leg rooted to the edge and extending away from the span, said first leg having a distal portion distant from the edge, and a depending leg joined to the distal portion and extending therefrom back toward said span; and (b) an outwardly standing web attachable to the unsupported span, the web having a footprint for mating with at least a portion of the profile of the unsupported span.

In a further feature of that aspect of the invention, the reinforcement is the longitudinal beam extending along the unsupported edge of the span. The beam has a first leg rooted to the edge and extending away from the span. The first leg has a distal portion distant from the edge, and a depending leg joined to the distal portion and extending therefrom back toward the span. The first and second legs are parts of a continuous roll formed section.

In yet a further feature, the longitudinal beam is a roof coaming formed integrally with the roof span. The first leg is an upstanding leg folded upwardly from the span. A rounded coaming is lip formed at the uppermost end of the upstanding leg, and the depending leg is folded downwardly from the lip.

In a second aspect of the invention there is a hopper car roof assembly having a desired roof profile, and having at least one unsupported roof span and a reinforcement attached to the span, the reinforcement having a web upstanding from the span and a footprint attached to at least a portion of the span for maintaining the profile over at least a portion said span.

In an additional feature of that aspect of the invention, the reinforcement has a toe for location adjacent to a longitudinal roof stiffening section, and a heel for location in a position to receive support from a top chord of the hopper car. The footprint is of a length for reinforcing the span between the beam and the section and of a pattern to mate with the roof profile in an orientation chosen from the set of orientations consisting of (i) perpendicularly to the beam; and (ii) at an oblique angle to the beam.

In an alternative feature of that aspect of the invention, the assembly comprises at least two webs attached to the roof in spaced relationship from each other. The webs, in plan view, are oriented transversely to the longitudinal direction in an orientation chosen from the set of orientations consisting of a) parallel to each other and perpendicular to the longitudinal direction; b) parallel to each other and angled obliquely to the longitudinal direction; c) one perpendicular to the longitudinal direction, and the other angled obliquely thereto; and d) one angled obliquely to the longitudinal direction at one angle, and the other angled obliquely at another angle.

In a further aspect of the invention there is a hopper car roof assembly wherein the roof assembly has a pair of opposed outboard edges. The roof is reinforced at each outboard edge by a top chord beam, and has a central trough bounded by a coaming. The roof assembly includes at least two of the reinforcements oriented, in plan view, to extend inwardly of one of the outboard edges toward the coaming in a manner chosen from the set of orientations consisting of (a) perpendicularly to the outboard edge in parallel spaced relationship to each other; (b) obliquely to the outboard edge in offset parallel relationship to each other; (c) one extending perpendicularly to the outboard edge and the other lying obliquely thereto; and (d) one lying obliquely at a first angle to the outboard edge and the other lying obliquely at a second angle to the outboard edge, the webs being surmounted by horizontally extending flanges; and running boards mounted to the flanges.

BRIEF DESCRIPTION OF THE DRAWINGS

For a better understanding of the present invention and to show more clearly how it may be carried into effect, reference is made by way of example to the accompanying drawings, which show an apparatus according to the preferred embodiment of the present invention and in which.

DETAILED DESCRIPTION OF THE PREFERRED EMBODIMENT

Figure 1:
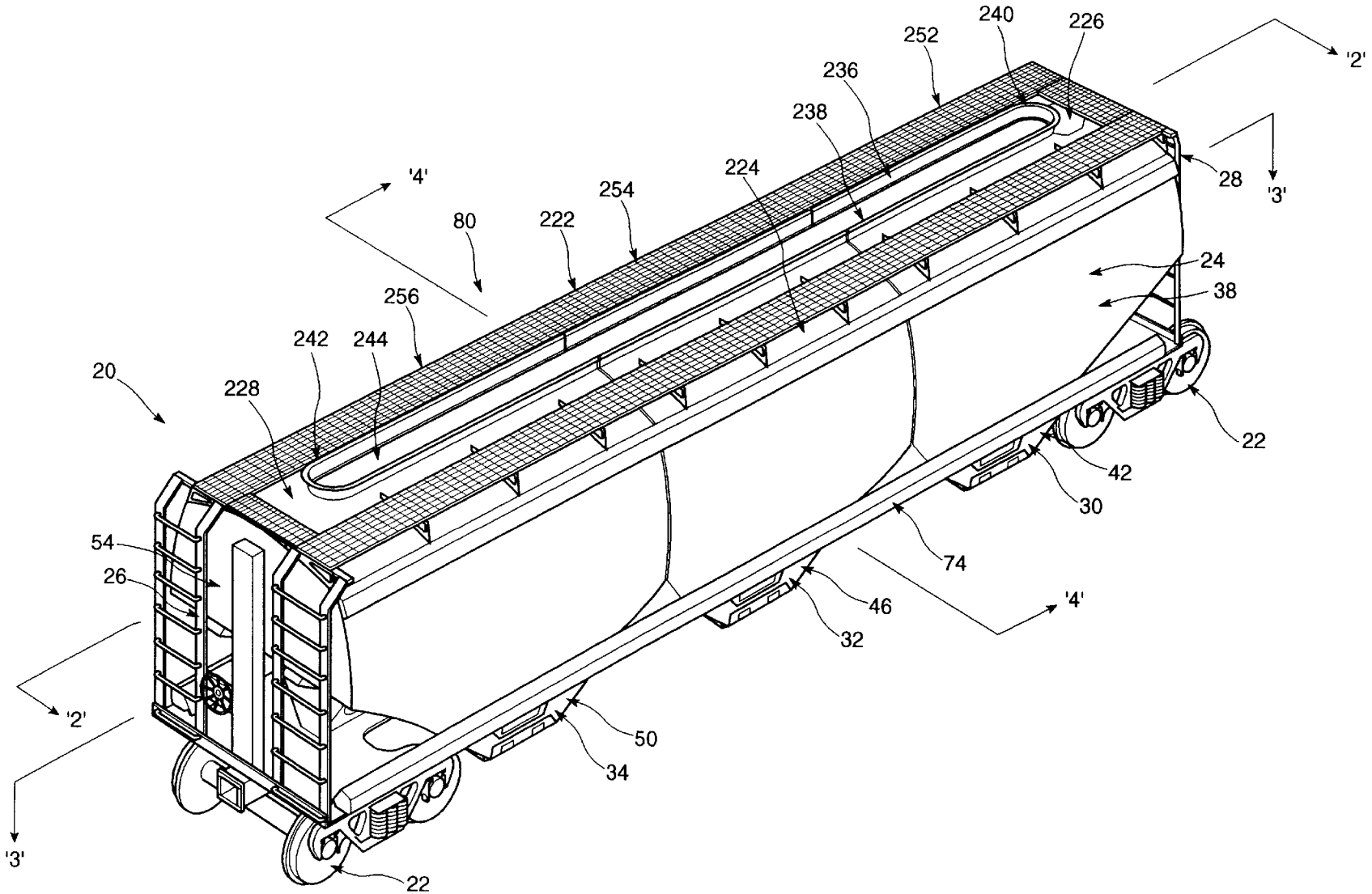
FIG. 1 is a general arrangement view of hopper car incorporating the present invention.
Figure 2:
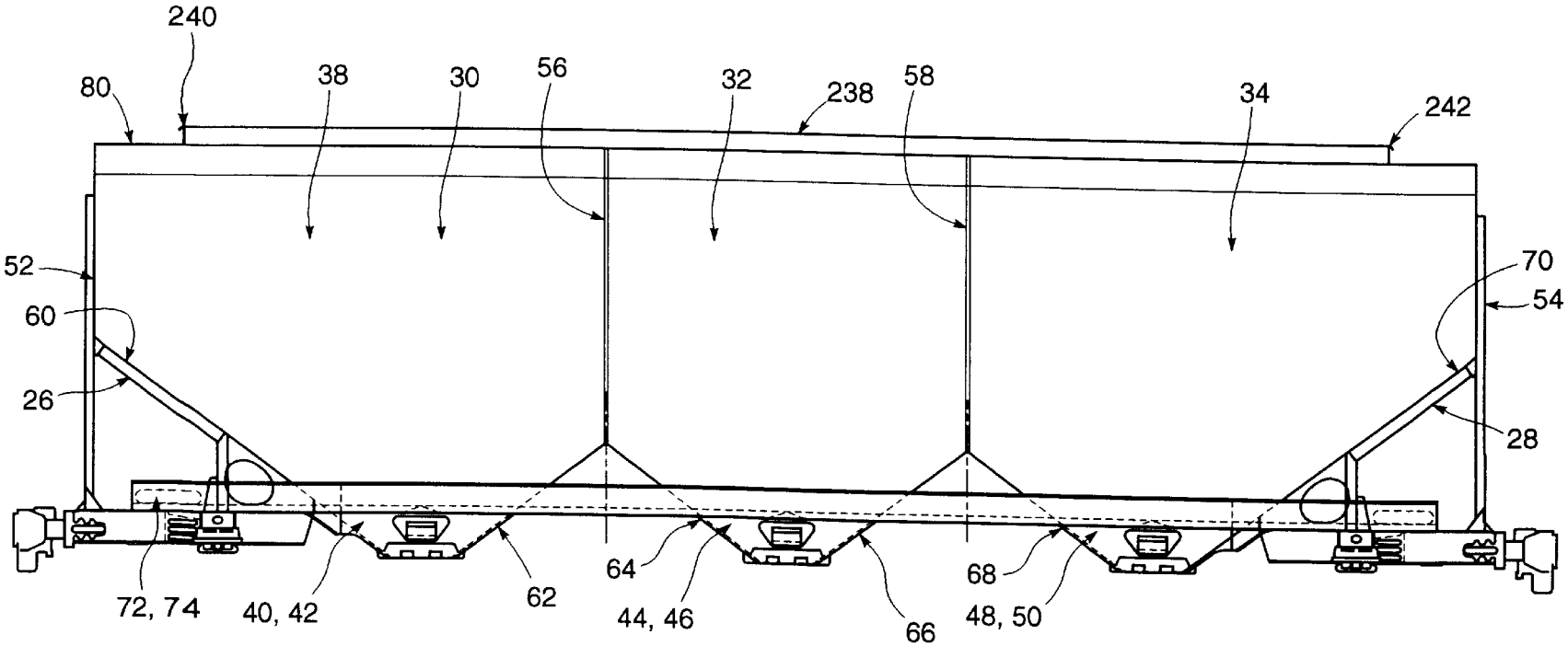
FIG. 2 is a longitudinal centre-line cross-section of the hopper car of FIG. 1 taken section '2—2'.
Figure 3:
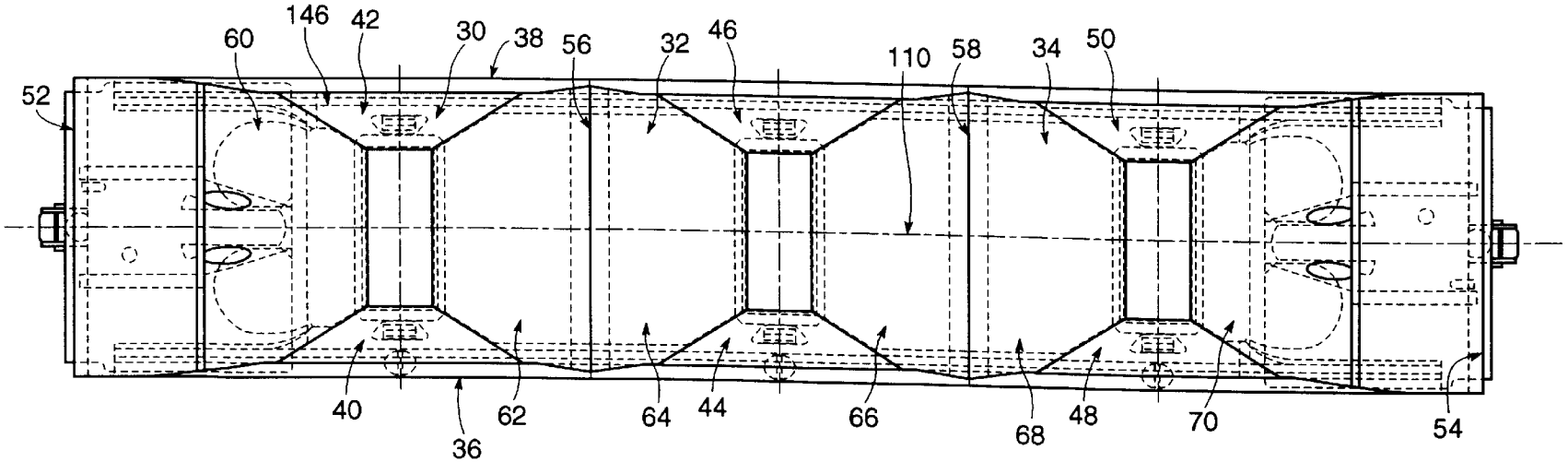
FIG. 3 is a plan section of the hopper of FIG. 1 taken on section '3—3'.

The description of the invention is best understood by commencing with reference to FIG. 1, in which some proportions have been exaggerated for the purposes of conceptual illustration.

Referring to the preferred embodiment of FIGS. 1, 2, 3 and 4, a hopper car of all steel construction is shown generally as 20. It has trucks 22 in the customary manner, upon which a railcar body 24 rests. The body has end structures 26 and 28 supported on trucks 20. Three hoppers 30, 32 and 34 are defined by a combination of left and right main side walls 36 and 38, respectively; left and right hand, foremost, middle and rearmost inwardly downwardly sloping side sheets, 40, 42, 44, 46, 48, and 50, respectively; end walls 52 and 54; internal bulkhead partitions 56 and 58; and foremost and rearmost sloped sheets 60, 62, 64, 66, 68, and 70, tied together and reinforced by left and right hand side sills 72 and 74 and top chords beams 76 and 78 all of which are attached to end structures 26 and 28 and covered by a roof assembly 80.

In general terms, roof assembly 80 and sidewalls 36 and 38 form a three sided, downwardly opening, thin shelled structure, similar to a monocoque. This thin shell is, in effect, wrapped around endwalls 52 and 54 and bulkhead partitions 56 and 58 and extends downwardly to the level of side sills 72 and 74. End walls 52 and sloped sheet 60, endwall 54 and slope sheet 70, and bulkhead partitions 56 and 58 act in general terms as frames, or formers, forming a skeleton to which the monocoque-like structure is attached like a skin. The individual members of the structure are relatively thin and flexible alone, but when assembled work together mutually to stiffen each other and the entire structure. The ability of such a structure to bear service loads generally depends on the ability of the unsupported spans between the formers to maintain their desired shape. The formers shown are all upstanding, but need not be vertically upstanding, and need not be parallel to give a desired stiffening effect when the skins are welded in place.

In the embodiment shown the distance between each adjacent pair of formers defines the fore-and-aft length of one of hoppers 30, 32, or 34. Generally speaking sidewalls 36 and 38 extend along the formers between the discharge assemblies of the hopper car and the superstructure which is typically a roof assembly.

Butt welded roof assembly 80 has predominantly longitudinally extending left and right hand roof panels 222 and 224, and predominantly laterally extending end region panels 226 and 228. Left and right hand roof panels 222 and 224 extend inwardly from top chord beams 76 and 78, nominally following the curve of the arcuate upper edges 230 and 232 of bulkhead partitions 56 and 58 to terminate at upstanding left and right hand, rounded-lip coamings 236 and 238. U-shaped end coaming styles 240 and 242 are let into end region panels 58 and 60 to mate with the coamings 62 and 64 to form a continuous periphery, the gap bounded thereby defining a trough 244 through which grain may be introduced to hoppers 30, 32 and 34.

Figure 9A:
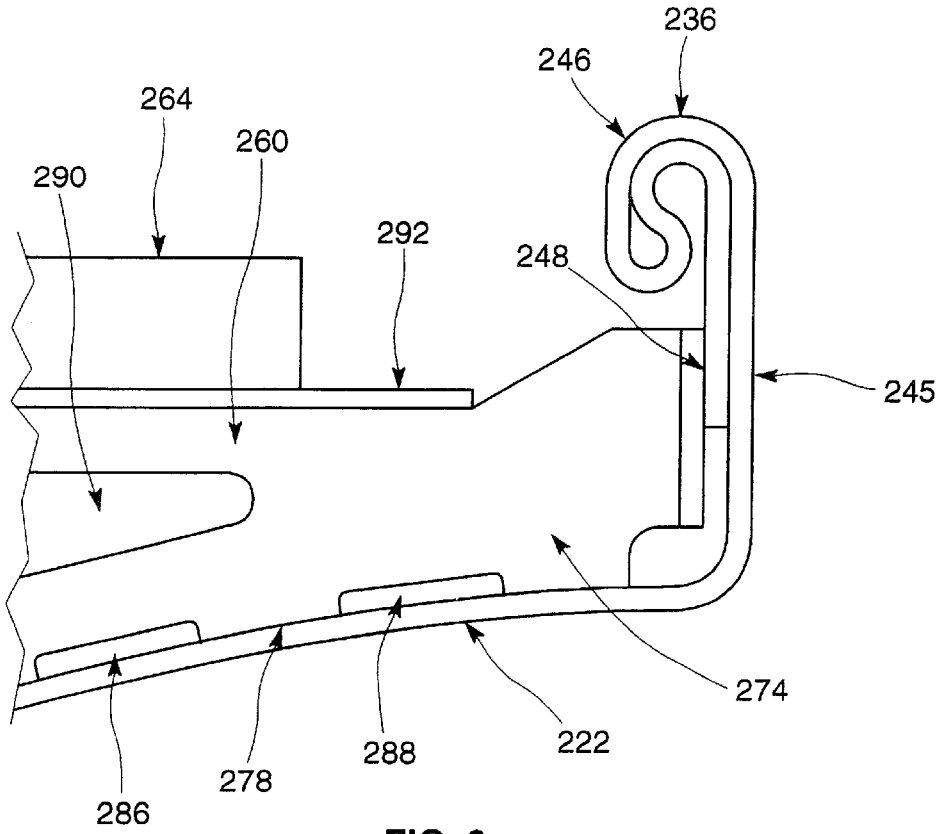
FIG. 9*a* enlarged detail of a coaming section for the roof of FIG. 5.

Since coamings 236 and 238 are formed integrally with roof panels 224 and 226 respectively in a roll forming process, they are made from the same thickness of material, i.e. 0.125 inch thick steel. The relatively deep, folded over sections of coamings 236 and 238, act like inboard longitudinal beams running along the otherwise unsupported inner edge of panel 224 or 226, and extend to reach across the longitudinal gap between partitions 56 and 58. To obtain a thicker coaming section, as illustrated in FIG. 9*a,* one may fold over a double thickness of sheet, and then pass it through rolls to form the coaming profile. Coaming 236 has a main leg 245 rooted to, and bent upwardly and outwardly away from, panel 222, a bulbous lip 246, curled back upon itself, and a depending leg 248 which extends approximately two thirds of the distance down the outside face of main leg 245 back toward panel 222. This unequal, double-leg design permits a stiffer coaming to be formed without additional welding.

Typical unsupported span 252 of roof panel 222 is bounded by end wall 52, bulkhead partition 56 and top chord beam 76. Typical unsupported span 254 is bounded by bulkhead partitions 56 and 58 and top chord beam 76. Typical unsupported span 254 is bounded by bulkhead partition 58, end wall 54, and top chord beam 76. Right and left hand carlines 260 and 262 surmount roof assembly 80, and provide a convenient support upon which to mount running boards 264 and 266. They replace the rung-like, 3/8 inch thick bent bar running board support brackets previously used for this purpose.

Figure 4:
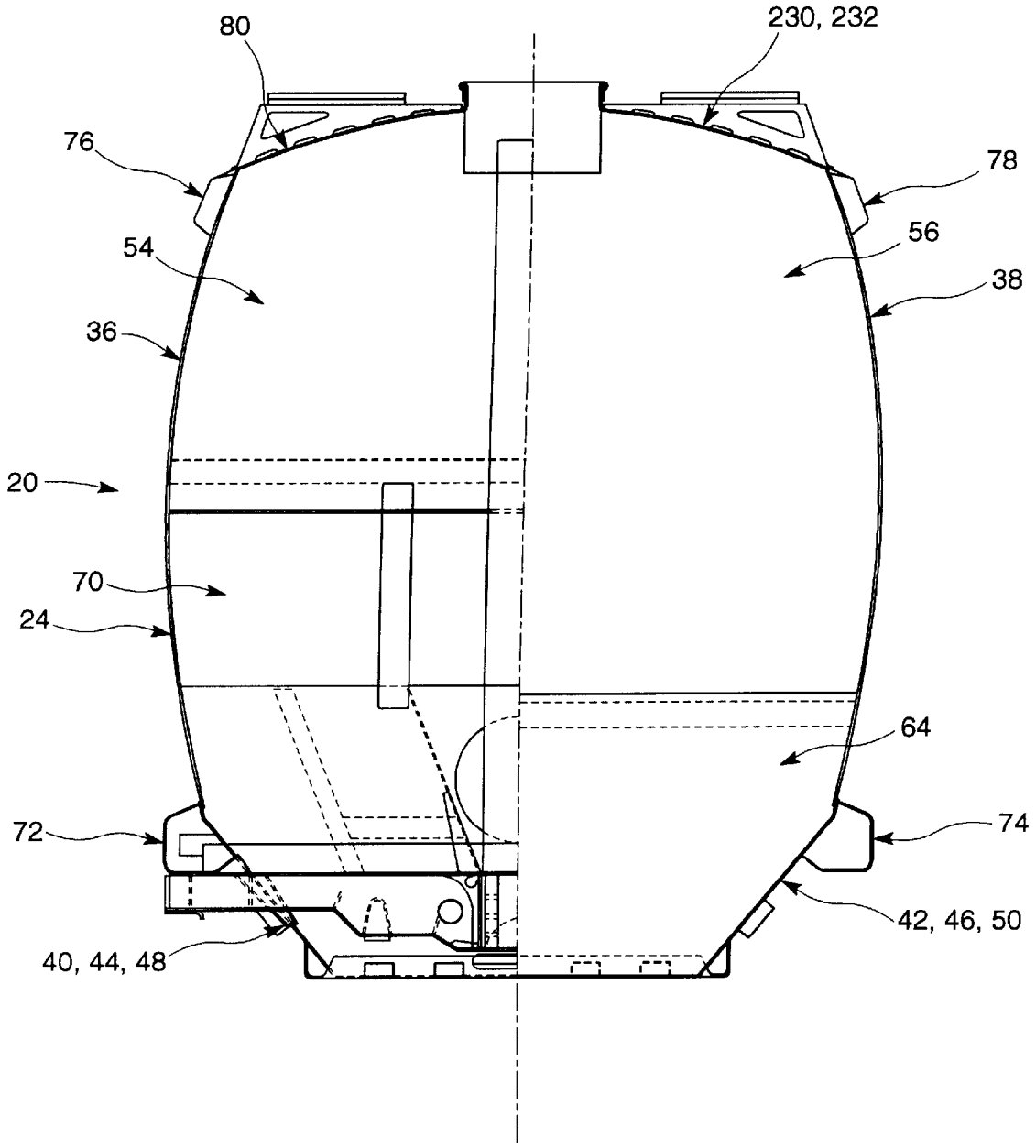
FIG. 4 is a lateral cross section of the hopper of FIG. 1 taken on section '4—4'.
Figure 5:
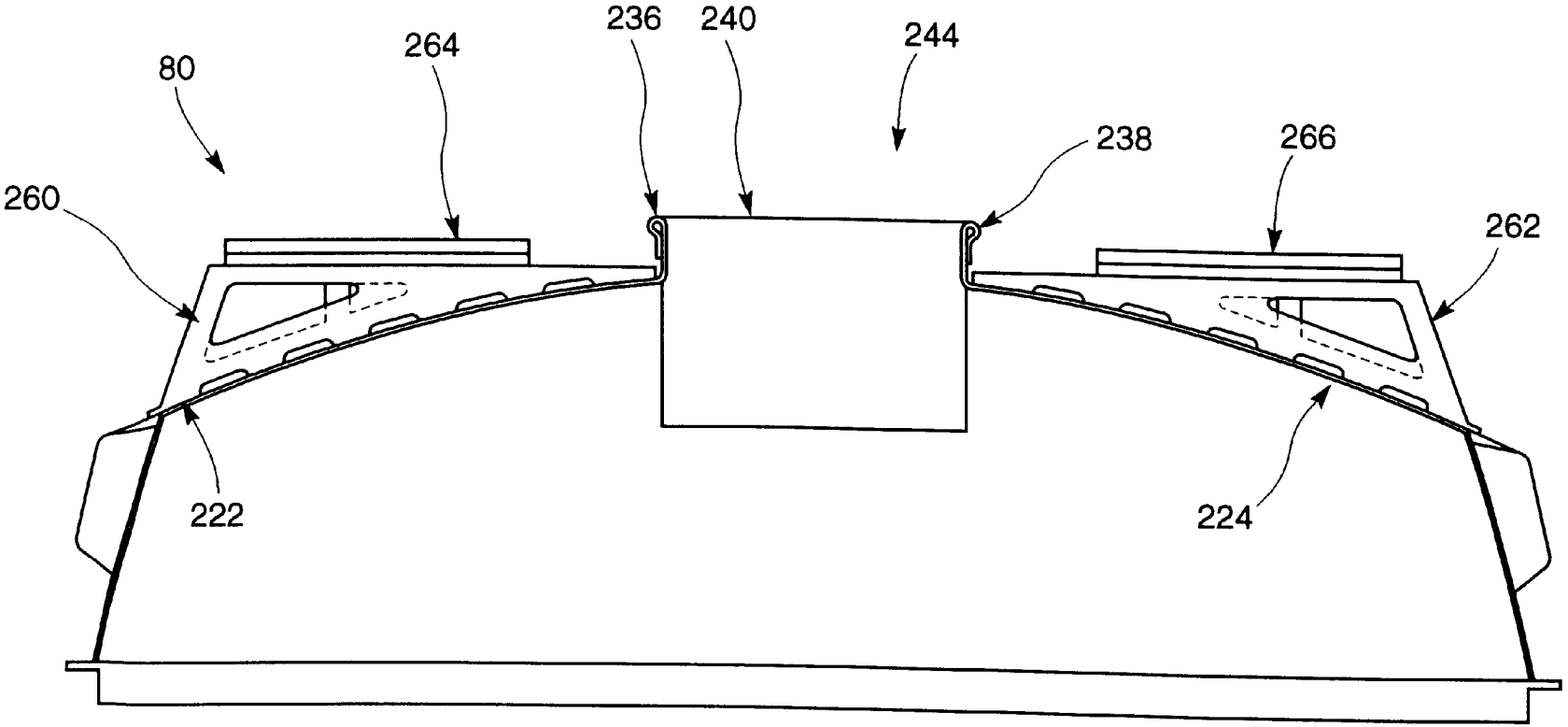
FIG. 5 shows a sectional view of a roof of the hopper car of FIG. 1.
Figure 6C:
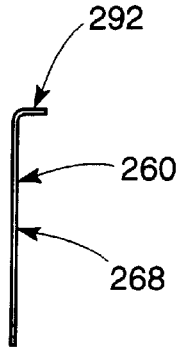
FIG. 6*c* shows an end view of the carline of FIG. 6*a;*
Figure 6B:
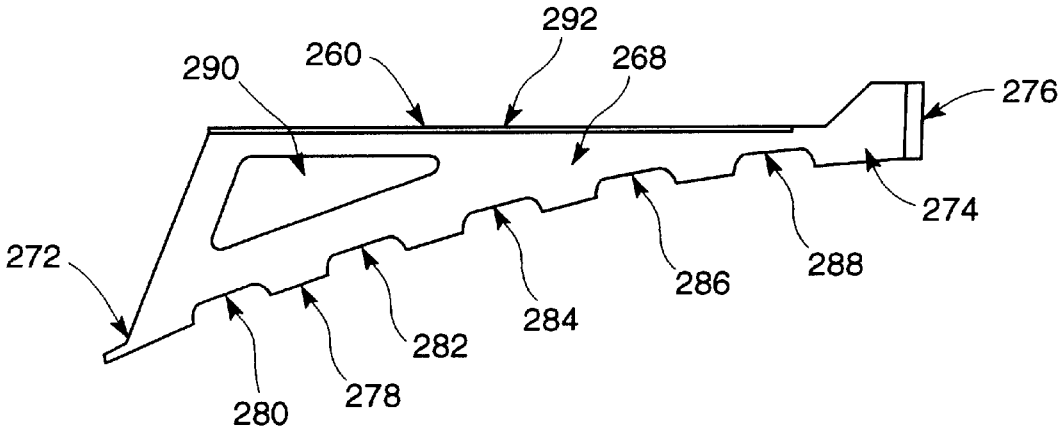
FIG. 6*b* shows a profile view of the carline of FIG. 6*a;*
Figure 6A:
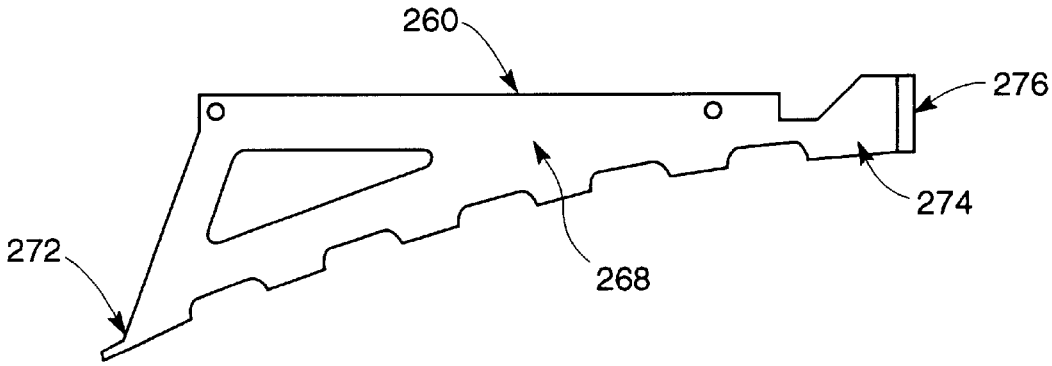
FIG. 6*a* shows a developed view of a carline for the roof of FIG. 5.

Carline 260, shown FIGS. 4 and 5, and in greater detail in FIGS. 6*a,* 6*b,* and 6*c,* has a web 268 oriented to stand upright, and to extend across roof panel 222 perpendicular to the longitudinal axis centreline 110 of hopper car 20 generally. Web 268 has a heel 272 welded to roof panel 222 near the juncture of roof panel 222, top chord beam 76, and main side wall 36. The web 268 has a gusset-like toe 274 having a first edge welded to the more or less horizontal arcuate portion of roof panel 222 and a web portion 276 extending roughly halfway up the height of, and welded to, leg 248 of the coaming 236. Further, the web 268 has a footprint 278 which a desired arcuate profile for mating with roof panel 222 and a number of reliefs 280, 282, 284, 286 and 288 therein. Web 268 also has a mid-web lightening hole 290, and a folded over flange 292, forming a stiffened spine for web 268. Running board 264 is attached to the web 268 by for example, a threaded fasteners as in the embodiment illustrated. The running boards also serve to stabilize neighbouring carlines 260 by maintaining them in fixed mutually parallel relationship to each other.

Figure 8A:
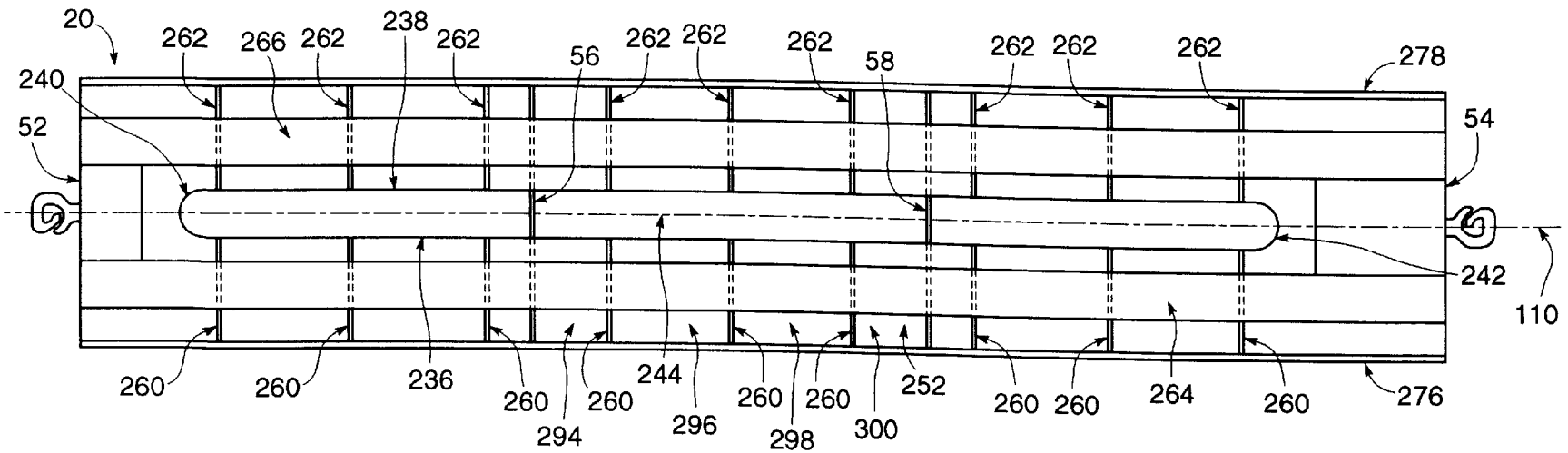
FIG. 8*a* shows a plan view of the roof of the hopper car of FIG. 1.

As shown, each carline 260 provides a stiff section between top chord beam 76 and coaming 236 and tends to reduce sagging at that section, not merely by virtue of its own stiffness but by tending to extend the range of influence of the torsional stiffness of the hollow section of top chord beam 76 further out into roof panel 222. Further, carline 260 also tends to maintain the orientation of coaming 242, that is it reduces the tendency of coaming 242 to twist. Further still, it tends to maintain the desired sectional profile of roof panel 222 and hence tends to maintain its resistance to buckling. The stiffness of carline 260 is such that, as illustrated in FIG. 8*a,* unsupported span 252 in the illustrated embodiment, roughly fifteen feet in length between bulkhead partitions 56 and 58, tends to have vibration properties similar to shorter panels 294, 296, 298 and 300.

In the preferred embodiment described above, roof panel 222 is 0.125 inches thick, as opposed to the 0.177 inch thickness butt welded roof panels currently used. Carlines 260 and 262 are made from 0.177 inch thick steel.

Figure 7A:
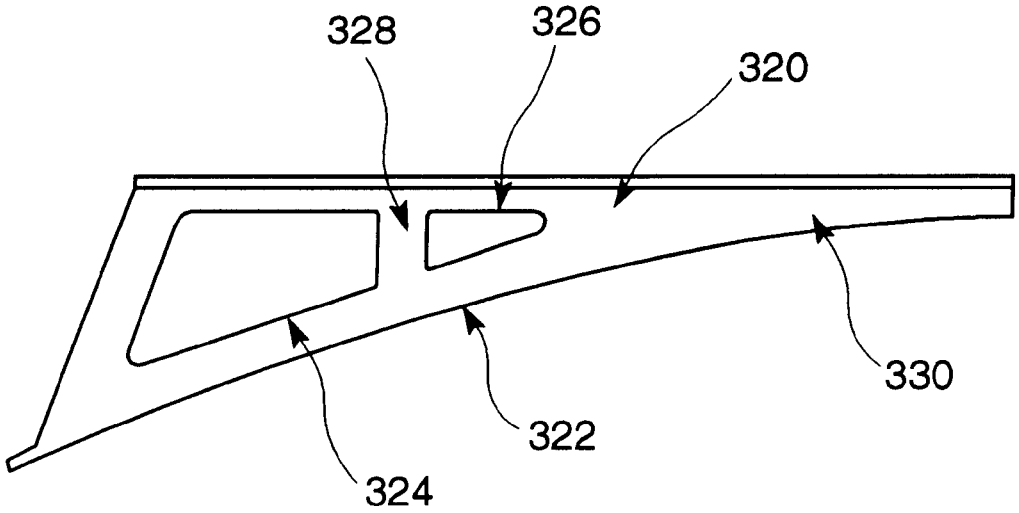
FIG. 7*a* shows an alternative carline to that shown in FIG. 6*b;*

Other embodiments of hopper roof reinforcement carline are shown in FIGS. 7*a,* 7*b,* 7*c,* and 7*d.* In FIG. 7*a,* a carline 320 has a continuous arc 322 without reliefs for fillet welding to roof panel 222. The carline 320 also has two lightening holes 324 and 326 bridged by a brace 328, and a toe 330 which does not extend fully to coaming 236.

Figure 7B:
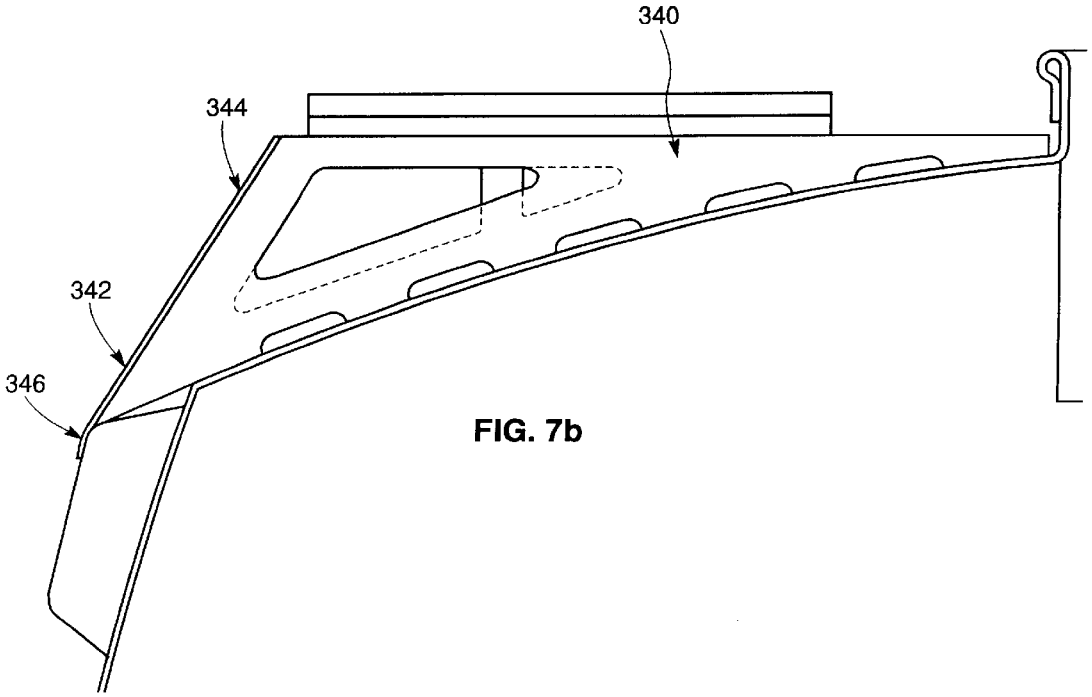
FIG. 7*b* shows an alternative carline to that shown in FIG. 6*b;*

In FIG. 7*b,* a carline 340 has a heel 342 extending outboard over top chord 76, and a flange 344 running along the back of heel 342. A finger 346 extends for welding to the outside face of top chord beam 76.

Figure 7C:
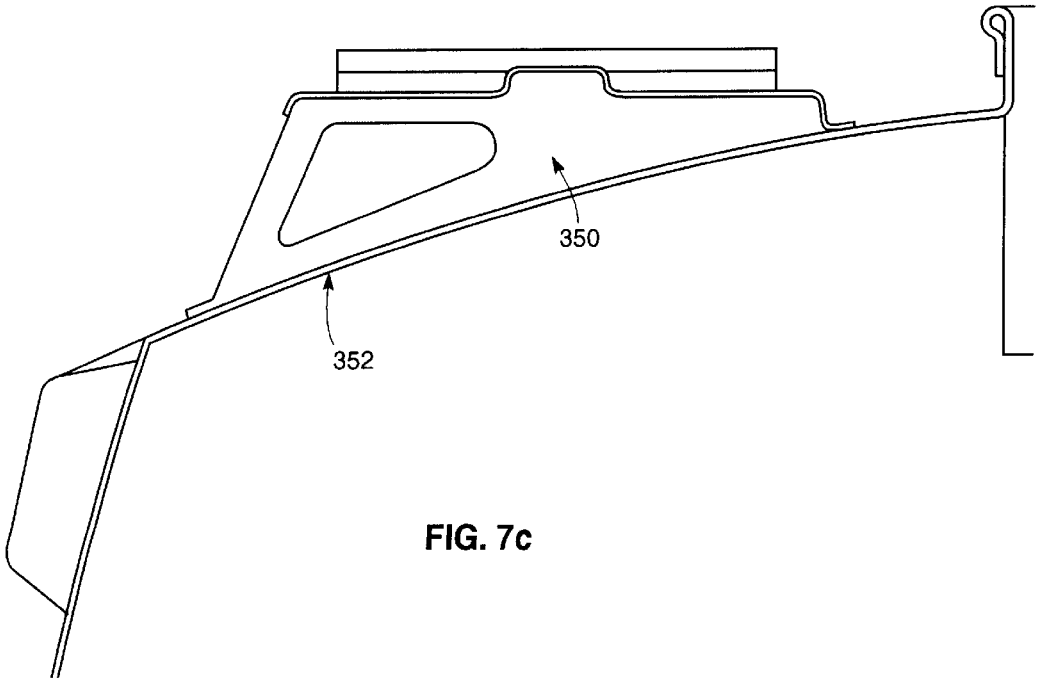
FIG. 7*c* shows an alternative carline to that shown in FIG. 6*b;*

In FIG. 7*c,* a carline 350 is shown having a foot print 352 which extends over only a partial arc of roof panel 222, but maintains the sectional profile of roof panel 222 over that arc.

Figure 7D:
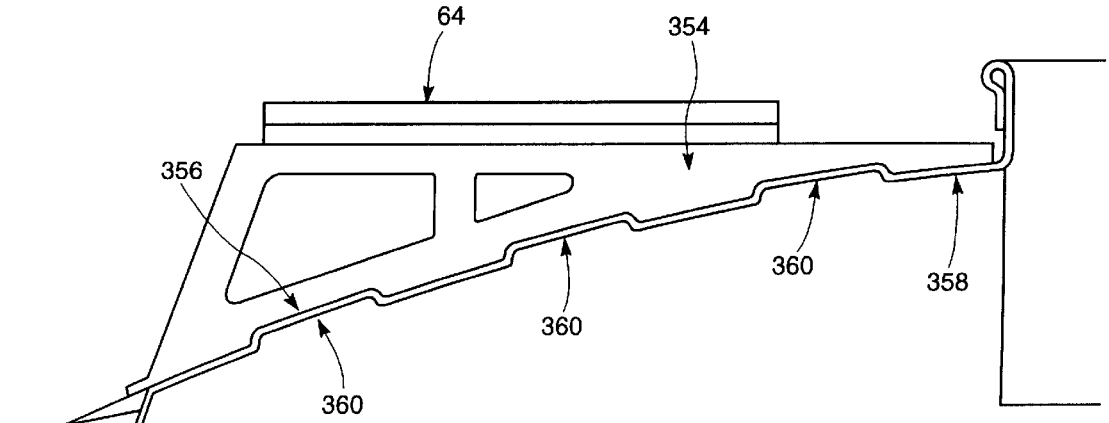
FIG. 7*d* shows an alternative carline to that shown in FIG. 6*b;*

In FIG. 7*d,* a further alternative carline 354 is shown having a footprint 356 for mating with a roof panel 358 having corrugations 360. These corrugations are shown as having the section of shallow, taper sided channels or ribs, but could be rectangular, triangular, or sinusoidal sections, or of some other chosen readily manufactured profile. The corrugations may have more or less ribs, of greater or lesser depth. In each case, the carline serves not only to stiffen roof assembly 80 but also supports running board 64.

Figure 7E:
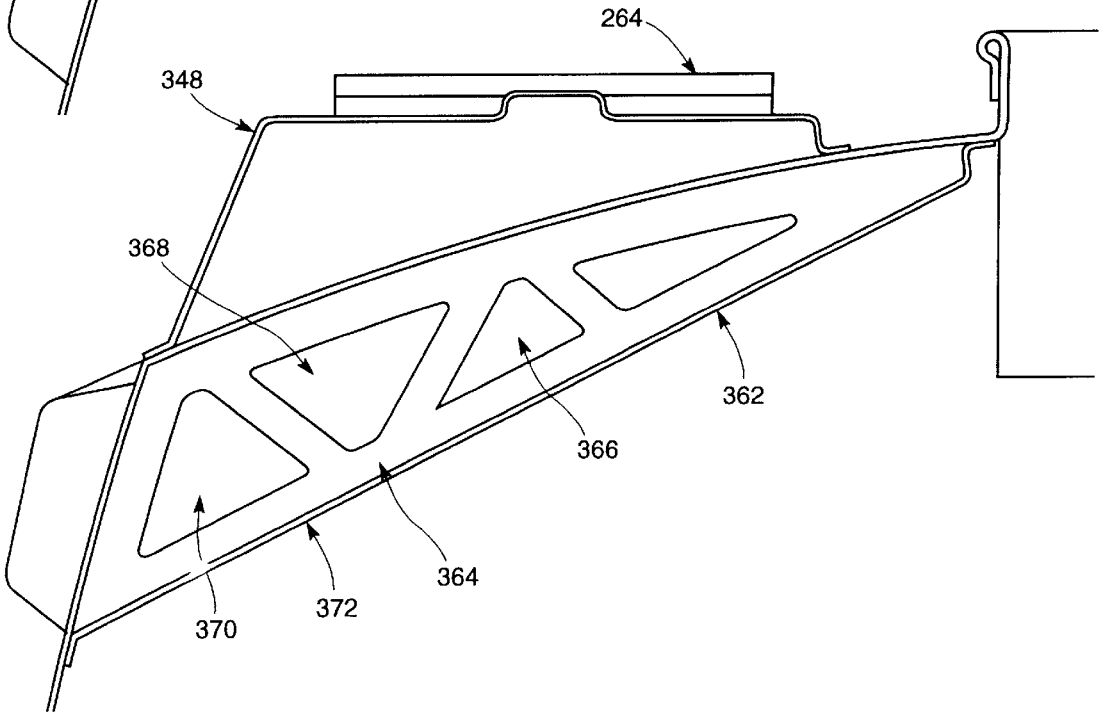
FIG. 7*e* shows an alternative carline to that shown in FIG. 6*b;*

An alternative internal brace is shown in FIG. 7*e* as 362, having a web 364, lightening holes 366, 368 and 370, a web flange 372, and a heel 374 welded to main side wall 36 in a position next to the top chord beam 76. Internal fittings are less favoured by the inventors, for the reasons noted above, and also because brace 362 does not also serve the second function of supporting running board 64, which must still be carried on a running board support 348.

Figure 8B:
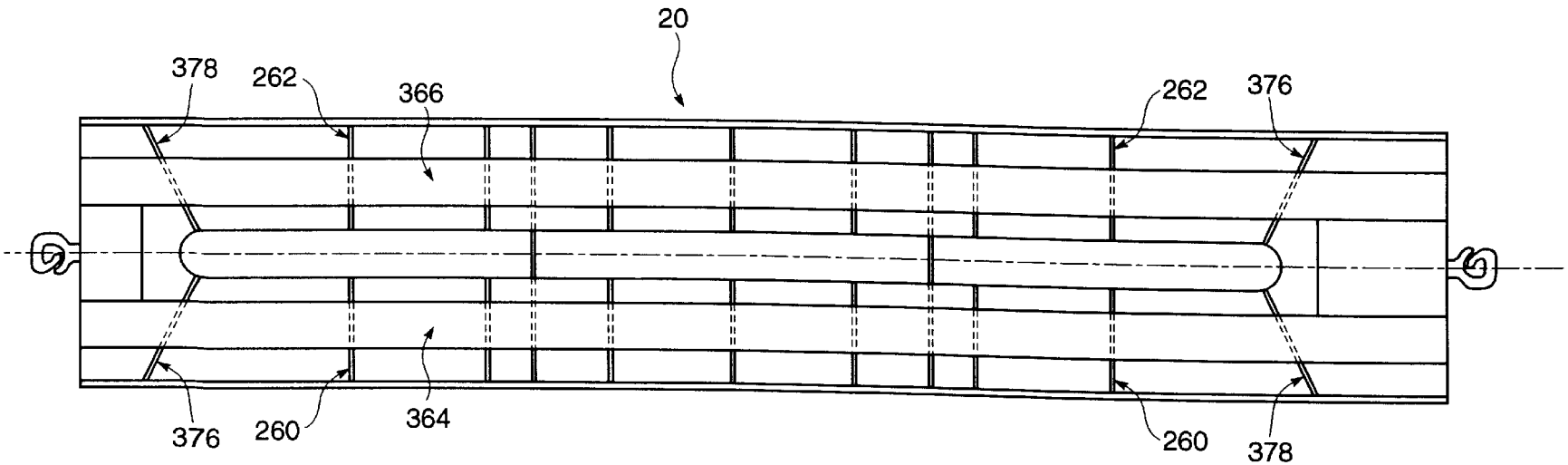
FIG. 8*b* shows a plan view of an alternative roof for the hopper car of FIG. 1.
Figure 8C:
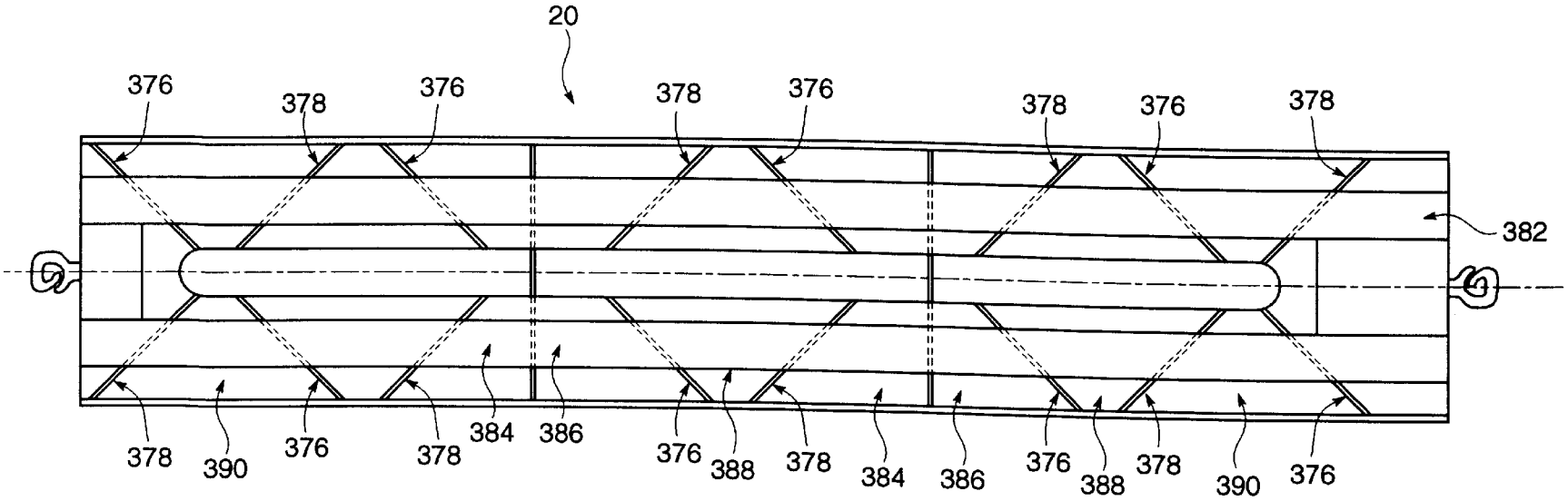
FIG. 8*c* shows a plan view of an alternative roof for the hopper car of FIG. 1.

While the illustrated, preferred, embodiment of FIG. 6*c* shows carline 260 having a web 268, which extends perpendicularly away from the roof panel 222, web 268 may extend away at an oblique upstanding angle. FIG. 8*a* shows a plan view of the preferred embodiment in which carlines 260 extend in parallel spaced relationship from each other perpendicularly to, and between, top chord beam 76 and coaming 236. FIG. 8*b* shows carlines 376 and 378 located at the diagonal at the corners of hopper car 20. FIG. 8*c* shows carlines 380 deployed in a diagonal pattern about roof assembly 372 leaving roughly triangular panels 374, 376, 378, 380.

Similarly, although the preferred embodiment employs specific arcuate footprint on a constant 130 inch radius of curvature, a different curvature, an arbitrary curve, a corrugated section, or a flat profile may be chosen to mate with the specific roof profile desired. Further still, although web 262 has been shown in a linear form it may, as seen from above, have a dog-leg, zig-zag, single arc, corrugated, or other chosen sectional profile. Flange 288 need not be folded over, but can alternatively be formed by, for example, welded fabrication. Similarly, while an all-welded car roof structure has been described other forms of fabrication could also be used including threaded fasteners, rivets, or bonding techniques.

Figure 9B:
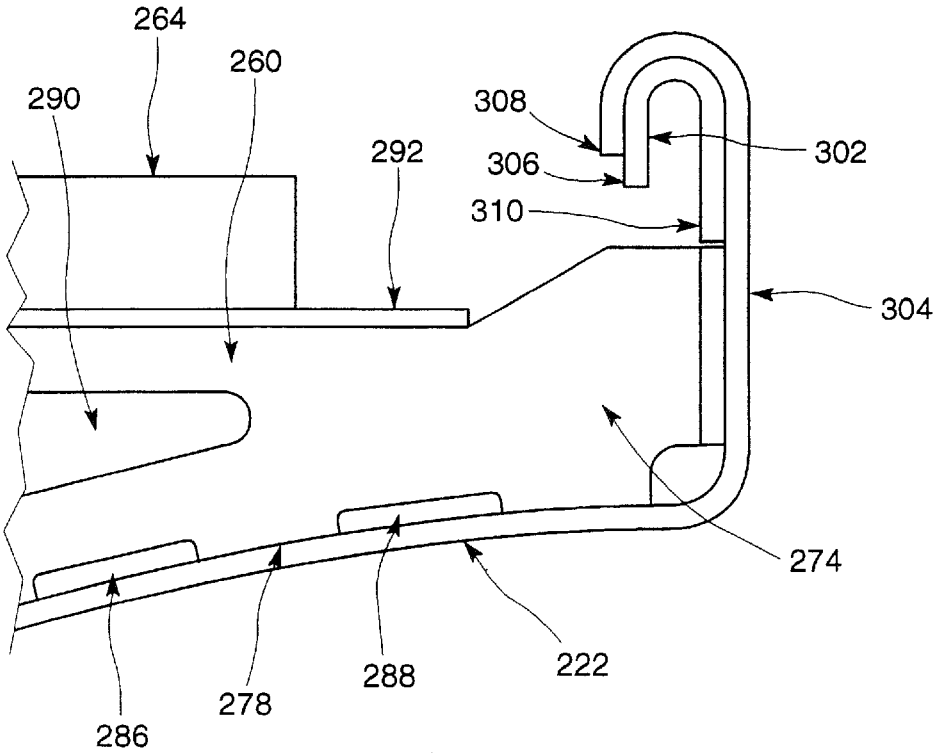
FIG. 9*b* shows an alternative embodiment of the coaming section of FIG. 9*a*.

FIG. 9*b* illustrates an alternative form of longitudinal roof coaming reinforcement. Rather than the integrally formed, bulbous-lipped folded embodiment shown in FIG. 9*a,* a curved coaming liner 302 is welded inside the folded curve of coaming 304. Liner 302 has an outer lip 306 which extends past the end of coaming lip 308 such that they may be fillet welded together more easily. Liner 302 also has a shank 310 extending down and stitch welded to the face of coaming 304. It will be appreciated that liner 302 can be mounted within the curve of coaming 304, or on the back side of coaming 304. Similarly in the embodiment of FIG. 9*a,* the material could be folded back on itself to give a depending shank lying on the hopper trough opening side of main leg 244.

Notably, while reinforcements in the nature of flutes have been described primarily in the context of main side walls 36 and 38, and reinforcements in the nature of transversely extending carlines have been described in the context of roof panels, while maintaining the overall envelope of the car, transverse stiffeners may be used to reinforce unsupported side wall panels, and longitudinal flutes may be used to stiffen the roof unsupported roof panels.

While a longitudinal reinforcement in the nature of longitudinally extending coamings is provided along the free edge of the otherwise unsupported spans of roof panels it would also be possible to deform the sections of those panels to provide longitudinal flutes or corrugations at intermediate locations relative to the arc between the respective side sills and coamings.

A particular preferred embodiment of the invention, and a number of alternative embodiments, have been described herein and illustrated in the figures. Those embodiments are described by way of illustration, and not of limitation, of the invention. The principles of the present invention are not limited to those specific embodiments, but are defined by the claims which follow, and equivalents thereof.

We claim:

1. A roof assembly for a railway hopper car, comprising:

an unsupported span subject to compressive forces applied in a longitudinal direction relative to the car, the span having a cross-sectional profile and an unsupported edge; and a reinforcement chosen from the set of reinforcements consisting of a) a longitudinal beam extending along an unsupported edge of the span, the beam having a first leg rooted to the unsupported edge and extending away from the span, the first leg having a distal portion distant from the edge, and a depending leg joined to the distal portion and extending therefrom back toward the span.

2. The roof assembly of claim 1 wherein the first leg rooted to the unsupported edge of the span extends upwardly from the span.

3. The roof assembly of claim 2 wherein the first and second legs are parts of a continuous roll-formed section.

4. The roof assembly of claim 1 wherein said depending leg is formed to lie alongside the first leg.

5. The roof assembly of claim 1 wherein said depending leg is a doubler attached to the first leg.

6. A roof assembly for a railway hopper car, comprising:

an unsupported span subject to compressive forces applied in a longitudinal direction relative to the car, the span having a cross-sectional profile; and a reinforcement in the nature of an upstanding web attached to the unsupported span, the web having a footprint attached to at least a portion of the span transversely to the longitudinal direction to maintain the shape of at least a portion of the profile.

7. The roof assembly of claim 6 wherein the web is surmounted by a flange.

8. The roof assembly of claim 6 wherein the roof assembly has a pair of outboard edges each supported by a top chord beam, and the web has a heel located to receive support from one of the top chord beams.

9. The roof assembly of claim 8 wherein the heel is located outboard of an inboard edge of the top chord beam.

10. The assembly of claim 5 wherein the roof assembly has an inboard, longitudinally extending, beam bordering the unsupported span, and the web has a toe for attachment to the span adjacent to the longitudinal beam.

11. The roof assembly of claim 9 wherein the inboard, longitudinally extending, beam is a coaming, the heel is located above one of the top chord beams and the web has a toe with a gusset attached to the coaming.

12. The assembly of claim 6 wherein the span is bordered by an outboard roof edge and the web runs in a direction inwardly from the outboard edge and reinforces at least a portion of the span.

13. The assembly of claim 6 wherein, in plan view, the web is oriented transversely to the longitudinal direction in an orientation chosen from the set of orientations consisting of:

a) perpendicular to the longitudinal direction; and b) angled obliquely to the longitudinal direction.

14. The assembly of claim 6 wherein the assembly comprises at least two of said webs attached to the roof in spaced relationship from each other, the webs, in plan view, being oriented transversely to the longitudinal direction in an orientation chosen from the set of orientations consisting of:

a) parallel to each other and perpendicular to the longitudinal direction;

b) parallel to each other and angled obliquely to the longitudinal direction;

c) one perpendicular to the longitudinal direction, and the other angled obliquely thereto; and d) one angled obliquely to the longitudinal direction at one angle, and the other angled obliquely to thereto at another angle.

15. The assembly of claim 14 wherein the webs co-operate to support a running board.

16. The assembly of claim 6 wherein the assembly further comprises a stiffener extending longitudinally across at least a portion of the unsupported span.

17. The assembly of claim 6 wherein:

the span has a longitudinally extending unsupported edge;

a longitudinally extending beam extends along the unsupported edge of the span;

the beam has a first leg rooted to the unsupported edge, said first leg extending away from the span;

the first leg has a distal portion distant from the unsupported edge, and a depending leg joined to the distal portion; and said depending leg extends from said first leg back toward the span.

18. The assembly of claim 17 wherein:

the longitudinally extending beam is a roof coaming formed integrally with the roof span;

the first leg is an upstanding leg folded upwardly from the span;

said longitudinally extending beam has a rounded coaming is lip formed at the uppermost end of the upstanding leg; and the depending leg is folded downwardly from the lip.

19. The roof assembly of claim 6 wherein said unsupported span has a longitudinally extending unsupported edge and a longitudinal roof stiffening section running along said unsupported edge.

20. The roof assembly of claim 19 wherein dais roof stiffening section extends upwardly relative to said span and said web has a portion attached to said roof stiffening section.

21. The roof assembly of claim 19 wherein:

said roof stiffening section is a roof coaming having an upstanding leg having a rounded coaming lip formed thereon; and said web has a toe attached to said coaming.

22. The hopper car roof assembly of claim 6 wherein the roof assembly has an outboard edge and the reinforcement is oriented, in plan view, with respect to the outboard edge in a manner chosen from the set consisting of:

a) substantially perpendicular to the outboard edge;

b) on a diagonal angle relating to the outboard edge;

c) on a dog-leg extending inboard of the outboard edge;

d) on a zig-zag pattern extending inboard of the outboard edge; and e) on a curve extending inboard of the outboard edge.

23. The hopper car roof assembly of claim 6 wherein the roof panel cross sectional profile is chosen from the set of profiles consisting of:

a) a straight line;

b) a conic section;

c) an irregularly constantly curved section;

d) a corrugated section; and e) a curved and corrugated section.

24. The hopper car roof assembly of claim 6 wherein the roof assembly comprises at least two of the reinforcements.

25. The hopper car roof assembly of claim 24 wherein the roof assembly has an outboard edge and the reinforcements are oriented, in plan view, to extend inwardly of the outboard edge in a manner chosen from the set consisting of:

a) perpendicularly to the outboard edge in parallel relationship to each other;

b) obliquely to the outboard edge in parallel relationship to each other;

c) one extending perpendicularly to the outboard edge and the other lying obliquely thereto; and d) one lying obliquely at a first angle to the outboard edge and the other lying obliquely at a second angle to the outboard edge.

26. The hopper car roof assembly of claim 25 wherein the reinforcements are surmounted by a running board.

27. The hopper car roof assembly claim 6 wherein:

the roof assembly has a pair of opposed outboard edges, is reinforced at each outboard edge by a top chord beam, and has a central trough bounded by a coaming;

the roof assembly has at least two of said reinforcements attached thereto, said reinforcements being oriented, in plan view, to extend inwardly of one of the outboard edges toward the coaming in a manner chosen from the set of orientations consisting of:

a) perpendicularly to the outboard edge in parallel spaced relationship to each other;

b) obliquely to the outboard edge in offset parallel relationship to each other;

c) one extending perpendicularly to the outboard edge and the other lying obliquely thereto; and d) one lying obliquely at a first angle to the outboard edge and the other lying obliquely at a second angle to the outboard edge;

the webs are surmounted by horizontally extending flanges; and running are mounted to the flanges.

28. A reinforcement for an unsupported span of a hopper car roof, the roof having a cross-sectional profile, comprising a web for upstanding orientation relative to the hopper car roof, the web having a footprint attachable to at least a portion of the span for maintaining at least a portion of the profile of the roof.

29. The reinforcement of claim 28 wherein the footprint includes at least one relief.

30. The reinforcement of claim 28 wherein the reinforcement has a heel locatable to receive support from a top chord of the hopper car.

31. The reinforcement of claim 30 wherein the heel has a stiffening flange.

32. The reinforcement of claim 28 wherein the reinforcement has a toe for location adjacent to a longitudinal roof stiffening section.

33. The reinforcement of claim 28 wherein the web is surmounted by a stiffening flange.

34. The reinforcement of claim 33 wherein the stiffening flange has mounting for permitting a running board to be mounted thereon.

35. The reinforcement of claim 33 wherein the web has at least one lightening aperture.

36. The reinforcement of claim 33 wherein the reinforcement has a toe for location adjacent to a longitudinal roof stiffening section; and a heel for location in a position to receive support from a top chord beam of the hopper car, and the footprint is of a length for reinforcing the span between the beam and the section and of a pattern to mate with the roof profile in an orientation chosen from the set of orientations consisting of (i) perpendicularly to the beam; and (ii) at an oblique angle to the beam.

* * * * *

UNITED STATES PATENT AND TRADEMARK OFFICE

CERTIFICATE OF CORRECTION

PATENT NO. : 6,164,210
DATED : December 26, 2000
INVENTOR(S) : James W. Forbes and Ilario A. Coslovi It is certified that error appears in the above-identified patent and that said Letters Patent is hereby corrected as shown below:

Column 1,
Line 13, after "useful" delete "," after "load" insert -- , --.

Column 2,
Line 12, delete "hoper" and insert -- hopper --.

Column 3,
Line 49, before "hopper car" insert -- a --.
Line 52, after "taken" insert -- on --.
Line 53, after "hopper" insert -- car --.
Line 55, after "hopper" insert -- car --.

Column 4,
Line 29, after "trucks" delete "20" and insert -- 22 --.
Line 45, after "end" delete "walls" and insert -- wall --.

Column 5,
Line 7, delete "58 and 60" and insert -- 226 and 228 --.
Lines 7 and 8, after "coaming" delete "62 and 64" and insert -- 236 and 238 --.
Line 12, delete "224 and 226" and insert -- 222 and 224 --.
Line 33, delete "254" and insert -- 256 --.
Line 51, after "footprint 278" delete "which" and insert -- with --.

Column 6,
Line 34, delete "64" and insert -- 264 --.
Line 41, delete "64" and insert -- 264 --.
Line 53, after "asembly" delete "372" and insert -- 382 --.
Lines 53 and 54, after "triangular panels" delete "374, 376, 378, 380" and insert -- 384, 386, 388, 390 --.
Line 56, delete "130" and insert -- 130 --.
Line 62, delete "288" and insert -- 292 --.

UNITED STATES PATENT AND TRADEMARK OFFICE

CERTIFICATE OF CORRECTION

PATENT NO. : 6,164,210
DATED : December 26, 2000
INVENTOR(S) : James W. Forbes and Ilario A. Coslovi It is certified that error appears in the above-identified patent and that said Letters Patent is hereby corrected as shown below:

Column 7,
Line 14, replace "244" with -- 245 --.

Column 8,
Line 12, delete "5" and insert -- 6 --.
Line 16, replace "9" with -- 10 --.
Line 44, after "obliquely" delete "to".

Column 9,
Lines 1 and 2 , replace "coaming is lip formed" with -- coaming lip formed --.
Line 10, replace "dais" with -- said --.
Line 22, delete "5" and insert -- 6 --.
Line 33, delete "roof panel".

Column 10,
Line 1, after "assembly" insert -- of --.
Line 22, after "running" insert -- boards --.
Line 24, insert -- said reinforcement -- before the word "comprising".

Signed and Sealed this

Twenty-third Day of April, 2002

*Attest:*

*Attesting Officer*

JAMES E. ROGAN
*Director of the United States Patent and Trademark Office*